United States Patent [19]

Parker

[11] 4,448,411

[45] May 15, 1984

[54] MULTI-USE BALANCE BEAM APPARATUS

[76] Inventor: Michael S. Parker, P.O. Box 200, Sorrento, Me. 04677

[21] Appl. No.: 457,402

[22] Filed: Jan. 12, 1983

[51] Int. Cl.[3] ..... A63G 1/32; A63G 11/00

[52] U.S. Cl. ..... 272/111; 272/30; 272/54

[58] Field of Search ..... 272/28 R, 29, 30, 46, 272/54–56, 111, 113, 109, 146, 114, 97

[56] References Cited

U.S. PATENT DOCUMENTS

| | | | |
|---|---|---|---|
| 2,417,618 | 3/1947 | Scott | 272/56 |
| 2,581,302 | 1/1952 | Schmechel | 272/29 |
| 3,201,120 | 4/1962 | Moravetz | 272/56 |
| 3,588,100 | 6/1971 | Schoenwald | 272/54 |
| 4,206,558 | 6/1980 | Bivona | 272/111 |

*Primary Examiner*—Richard J. Apley
*Assistant Examiner*—S. R. Crow
*Attorney, Agent, or Firm*—Daniel H. Kane, Jr.

[57] ABSTRACT

A multi-use balance beam apparatus is formed by cooperating elements which may be arranged to form a rocker, see-saw, merry-go-round, balance beam, and walking rails. A pair of balance beams, each in the form of a pair of parallel spaced apart rails are constructed to cooperate in a variety of configurations. Additional elements including a locking piece, turning pedestal, and rail retaining guide cooperate with the balance beams to achieve the different functions. The device is useful for child development exercises and a variety of recreational activities.

15 Claims, 8 Drawing Figures

MULTI-USE BALANCE BEAM APPARATUS

TECHNICAL FIELD

This invention relates to a new versatile apparatus for engaging in a variety of developmental exercises and recreational activities. The cooperating elements of the apparatus may be arranged to form a rocker, see-saw, merry-go-round, balance beam, and walking rails, for developing body awareness, eye/body coordination, motor development, and muscular coordination. The invention also provides multiple opportunities for recreation, entertainment and play, particularly for children.

BACKGROUND ART

A variety of children's toys and playthings have been developed affording single purpose exercise play such as rocking, balancing, cooperative play, or visual coordination. Such playthings, however, are generally limited to such single purpose use or only a limited range of uses.

OBJECTS OF THE INVENTION

It is therefore an object of the present invention to provide a versatile apparatus of cooperating elements which may be arranged in a variety of interfitting relationships for multi-use purposes in developmental exercises and play activities.

Another object of the invention is to provide a multipurpose play apparatus which may be used as a rocker, see-saw, merry-go-round, balance beam, and for one and two rail walking.

A further object of the invention is to provide a versatile apparatus for exercise play and creative developmental activities useful in developing eye/body coordination, body awareness, muscular coordination vestibular stimulation, and cooperative play among groups of children.

DISCLOSURE OF THE INVENTION

In order to accomplish these results the invention provides a multi-use recreational balance beam device formed by first and second balance beams constructed to cooperate in a variety of configurations. Each balance beam comprises a pair of parallel spaced apart rails. Each rail is formed with a straight side edge and a curved side edge. A pair of platform seats rigidly join and space the pair of rails at each end and the platform seats are joined to the straight side edges of the pair of rails so that the straight side edges lie in a common plane and the curved side edges lie in a common surface of curvature for rocking action.

According to the invention, one of the balance beams is formed with a pair of notches in the straight side edge of each rail centered along the rail and spaced apart from each other, a distance equal to the spacing of the rails from each other. The second balance beam is formed with a pair of notches in the curved side edge of each rail centered along the rail and similarly spaced. The first and second balance beams may therefore be arranged in interfitting or interlocking relationship at right angles to each other defining a rectangle at the center of the interfitting balance beams. The notches are formed so that the flat side edges of the rails of both the respective beams lie in a common plane.

The basic structure of the invention in the form of the interfitting balance beams may be arranged with the platform seats facing downward and flush with the surface of the ground forming a stable base. The children or other users may in this position engage in one or two rail walking along the curved side edges of the interfitting balance beams in either of two directions. With the curved side edges facing downward and bearing against the ground a four person see-saw or rocker is provided with see-saw or rocking action in either of two dimensions or directions.

The invention also contemplates a number of other cooperating and interfitting elements to increase the range of opportunities for developmental activities and exercise play afforded by the balance beam device. For example, the invention also provides a locking piece in the form of a locking plate with depending inserts for engaging and bearing against the inner surfaces of the center rectangle of the interfitting balance beams. The locking piece maintains and rigidifies the interfitting balance beams for two dimensional rocking and cooperative play among a group of children.

When inserted into the center rectangle of the interfitting balance beams from below with the curved side edges facing downward a merry-go-round or turning or spinning device is provided. This is accomplished by inserting or coupling a turning disc into the locking plate to afford a reduced bearing surface of the interfitting balance beams relative to the ground for ease in turning or spinning by players sitting on the platform seats.

Other cooperating elements contemplated by the invention are the guide plates and guide bars joined in a rigid structure seated with the guide bars in the notches formed in the curved side edges of the second balance beam. The second balance beam is oriented with the curved side edges of the rails facing upward and the guide plates held adjacent to the outer surfaces of the rails. The second balance beam is thereby operatively retained by the guide plates on top of the second balance beam with respective curved side edges bearing against each other to form a see-saw with increased or amplified vertical rocking action.

According to other aspects of the invention strips of non-slip material are used on the playing surfaces and bearing surfaces of the device and visual targets may be provided for eye/body coordination during the various developmental activities and exercises.

Other objects, features and advantages of the invention are set forth in the following specification and accompanying drawings.

DETAILED DESCRIPTION OF PREFERRED EXAMPLE EMBODIMENTS AND BEST MODE OF THE INVENTION

Figure 1:
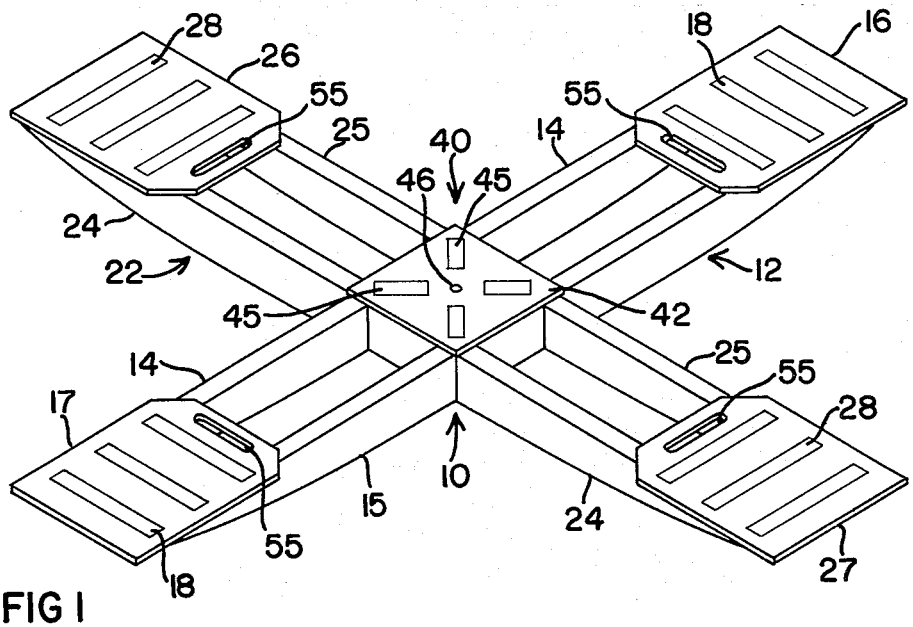
FIG. 1 is a perspective view of the interfitting balance beam device with locking piece in place forming a two way rocker.
Figure 2:
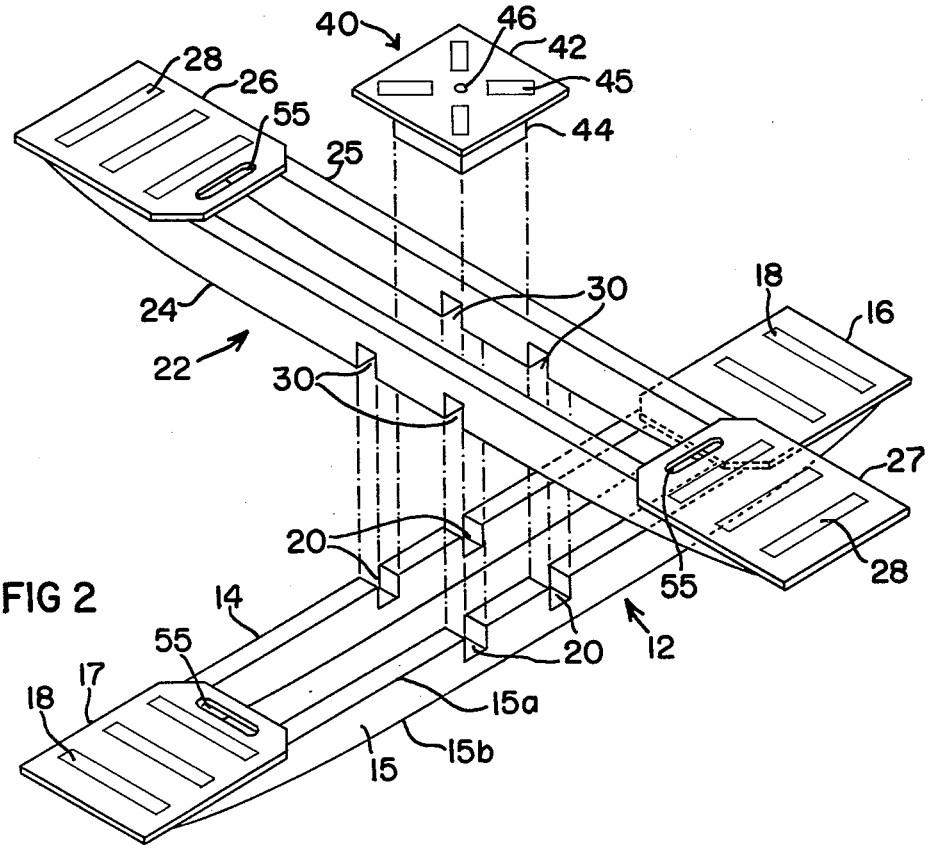
FIG. 2 is an exploded view in perspective of the rocker of FIG. 1.

Referring to FIGS. 1 and 2, the basic structure of the invention comprises a pair of interfitting balance beams 12 and 22. The first balance beam 12 comprises a pair of parallel spaced apart rails 14 and 15. Each rail, for example rail 15, comprises a straight side edge 15*a* and a curved side edge 15*b*. A pair of platform seats 16 and 17 rigidly join and space the pair of rails 14 and 15 at each end. The platform seats 16 and 17 are secured to the straight side edges of the pair of rails 14 and 15 so that the straight side edges lie in a common plane and the curved side edges lie in a common surface of curvature for rocking action.

Similarly, the second balance beam 22 is comprised of parallel spaced apart rails 24 and 25, each rail similarly constructed with a straight side edge and curved side edge. The platform seats 26 and 27 rigidly join and space the pair of rails 24 and 25 at each end and the platform seats are secured to the straight side edges so that the straight side edges lie in a common plane. Each of the platform seats 16, 17, 26, and 27 are formed with a handle 55 at the inside of the seat between the pair of rails so that a player sitting on the platform seat may hold on and maintain balance with hands safely away from the vicinity of the ground contact side of the rails of the balance beam.

Figure 3:
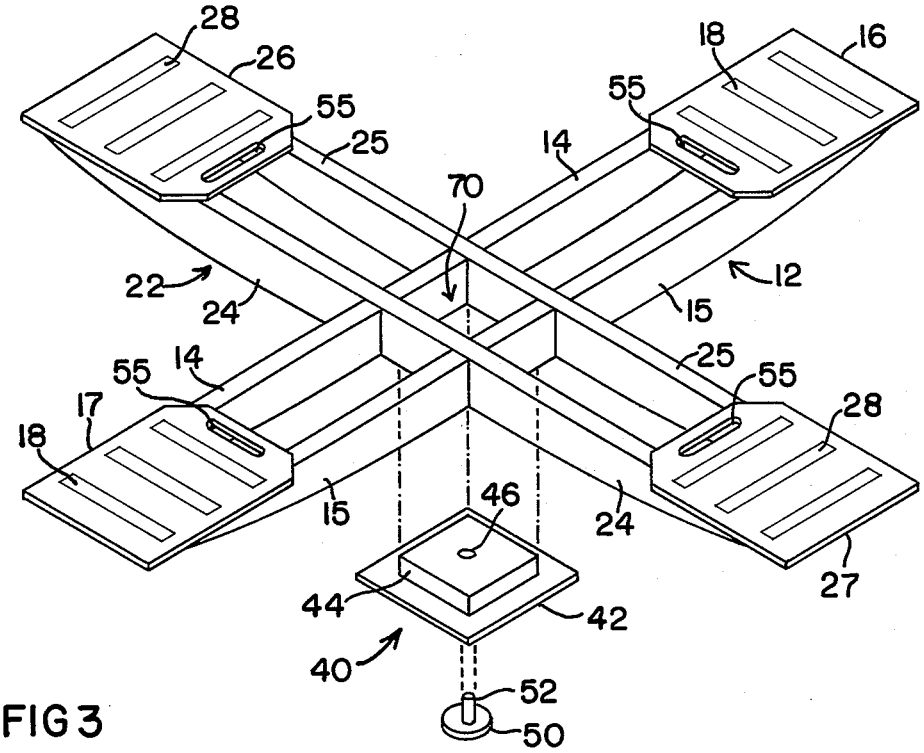
FIG. 3 is a perspective view partially exploded of the interfitting balance beam device and cooperative elements arranged to function as a merry-go-round or turning or spinning device.

The rails 14 and 15 of the first balance beam 12 are formed with a pair of notches 20 in the straight side edge of each rail 14 and 15. The notches 20 are centered along the rail and spaced apart from each other a distance equal to the spacing of the rails from each other. The pair of rails 24 and 25 of the second balance beam 22 are formed with a pair of notches 30 in the curved side edge of each rail. The notches 30 are also centered along the rail and spaced apart from each other a distance equal to the spacing of the notches 30. The balance beams 12 and 22 may therefore be arranged in interfitting or interlocking relationship at right angles to each other defining a rectangle 70 at the center of the interfitting balance beams as shown in FIG. 3. The notches 20 and 30 are formed half way through the respective rails so that the flat side edges of the rails of the respective beams 12 and 22 lie in a common plane.

With the interfitting balance beams oriented with the curved side edges facing downward and bearing against the ground as shown in FIG. 1, a two way rocker or see-saw is provided. For such use, a locking piece 40 is inserted in the center rectangular space 70. The locking piece 40 is formed by a locking plate 42 having depending insert 44 which engages and bears against the inner surfaces of the center rectangle 70 formed by the rails of the interfitting balance beams. The locking plate 42 bears against the side edges of the respective rails when the locking piece is inserted in the center rectangle. The locking piece 40 thereby serves to rigidify and secure the interfitting balance beams for rocking motion as a single cooperative unit.

Figure 6:
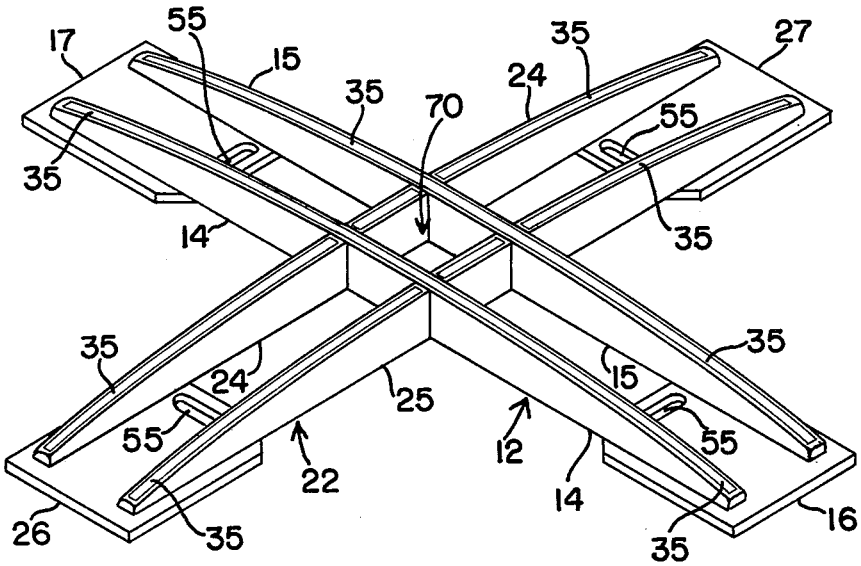
FIG. 6 is a perspective view of the interfitting balance beam device with platform seats flush with the ground to form a stable two directional balance beam base for one and two rail walking.

With the interfitting balance beams inverted as shown in FIG. 6 with the platform seats flush with the surface of the ground, a stable base is provided for one or two rail walking in either of two directions along the curved side edges of the rails of the interfitting or interlocking balance beams. As shown in FIG. 6, strips 35 of non-slip material may be adhesively applied or otherwised formed along the curved side edges to provide non-slip surfaces for walking or for engaging the ground.

Figure 4:
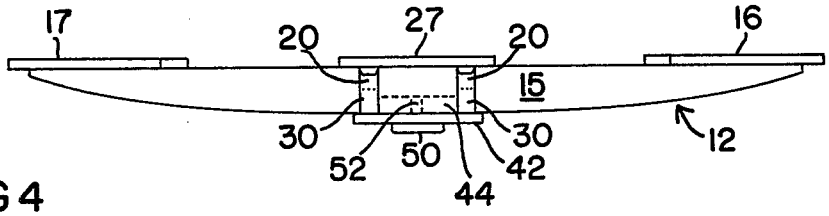
FIG. 4 is a plan view from the side of the merry-go-round of FIG. 3.

The interfitting balance beams may also function as a merry-go-round or turning and spinning device as shown in FIGS. 3 and 4. According to this cooperative relationship of the elements of the invention, the locking piece 40 is inserted into the center rectangle 70 from below. The interfitting balance beams are oriented so that the curved side edges of the rails are facing downward as shown in FIG. 3. A turning disc or pedestal 50 is then coupled to the locking plate 42 to provide a reduced bearing surface of the interfitting balance beams relative to the ground for ease in turning. The turning disc or pedestal 50 is provided with a stem 52 for coupling to the locking piece by inserting the stem 52 through the central hole 46 formed in the locking plate 42 and insert 44. According to this arrangement of elements, turning of the interfitting or interlocking balance beams by players sitting on the respective platform seats is facilitated.

Figure 5:
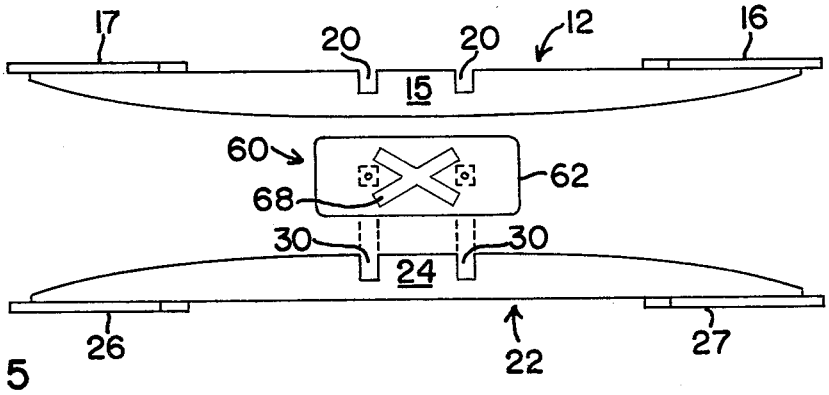
FIG. 5 is an exploded view of the balance beam device with elements including the guide plates and guide bars cooperating to form a see-saw.
Figure 5A:
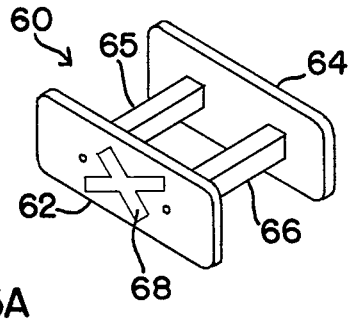
FIG. 5A is a perspective view of the guide plates and guide bars joined in a rigid structure and also showing a visual target formed on one of the guide plates.

A two person see-saw is provided by the configuration of elements shown in FIGS. 5 and 5A. In this arrangement the second balance beam 22 is oriented with the platform seats 26 and 27 flush with the ground to form a stable base. The notches 30 in the rails 24 and 25 are therefore facing upward. A pair of guide plates 62 and 64 are rigidly joined by a pair of guide bars 65 and 66 to form a rail retaining guide or structure 60 as shown in FIG. 5A. The guide bars 65 and 66 are spaced from each other the same distance as notches 30 so that the bars 65 and 66 may be seated within the notches 30 for maintaining the guide plates 62 and 64 substantially adjacent to the outer surfaces of the guide rails 24 and 25. The guide plates 62 and 64 of the rail retaining guide 60 operatively retain the first balance beam 12 on top of the second balance beam 22 with respective curved side edges bearing against each other to form a see-saw with increased or amplified vertical rocking action.

It is noted that throughout the various configurations of the invention the various elements may be provided with strips of non-slip material which function also as visual cues and targets. For example, non-slip material strips 18 are provided on platform seats 16 and 17 while similar strips of material 28 are provided on platform seats 26 and 27. The non-slip material strips facilitate maintenance of position and balance for either standing or sitting on the platform seats. Similarly, strips 45 are provided on the locking plate 42 of locking piece 40. The strips 45 are arranged in a four way pattern as shown in FIGS. 1 and 2 to provide a visual focus and target for balancing activities in addition to affording a non-slip bearing surface.

Figure 7:
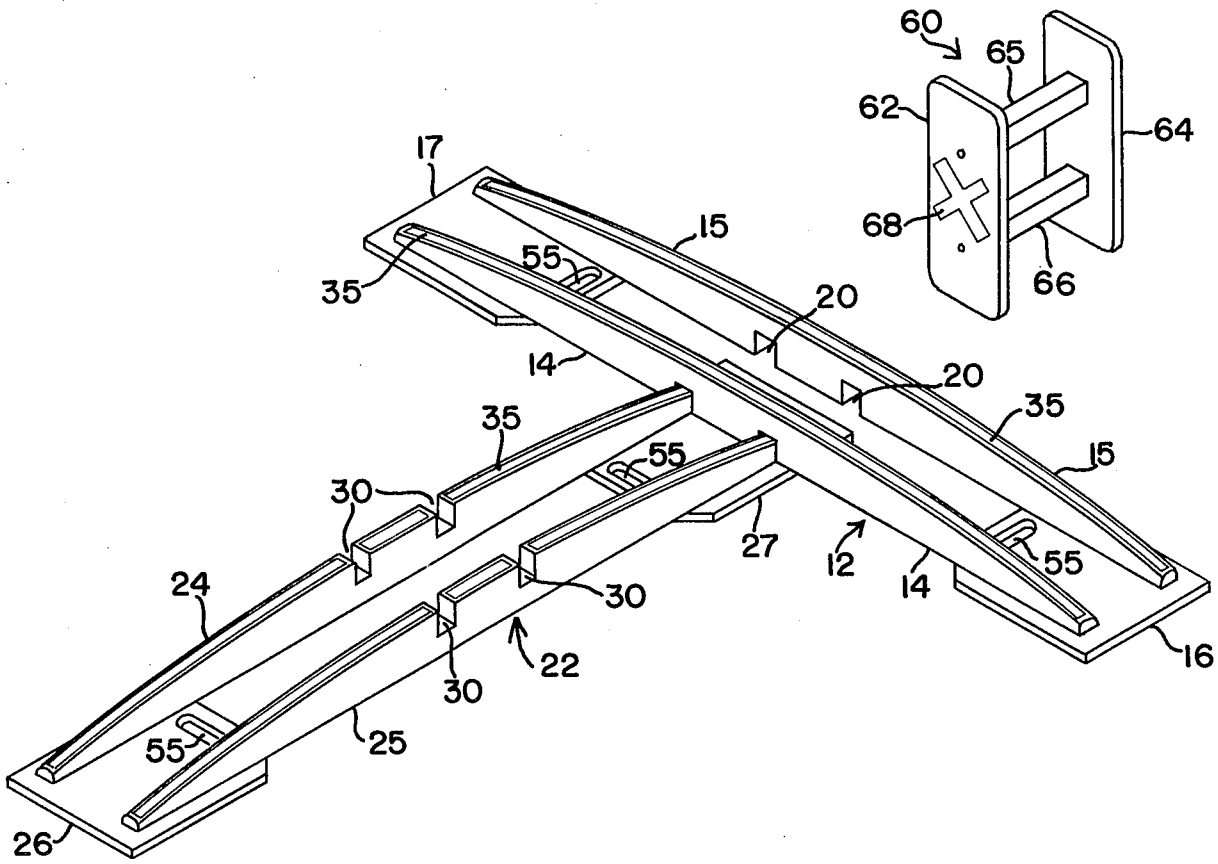
FIG. 7 shows a cooperating relationship of the elements of the balance beam device for one and two rail walking in relation to a visual target.

A target 68 of strip material is also provided on one of the guide plates 62 of the rail retaining guide 60. The rail retaining guide or structure 60 may therefore function as a spaced apart and free standing visual target as shown in FIG. 7 to facilitate exercise of eye/body coordination during one and two rail walking, for example, along the rails 24 and 25 of balance beam 22, all as shown in FIG. 7. In this arrangement the target 68 provides visual attention and coordination in the direction of walking along the beam 62 or at right angles to the side of the direction of walking on rails 14 and 15 of balance beam 12. In each instance of the use of non-slip material strips such as the strips 18, 28, 35, 45 and 68, a bright color may be selected such as a clear or glossy white for contrast with darker colors used for the platform seats and other elements of the interfitting balance beam device. Where the strip material is functioning as a visual target only, paint or other coloration may be used instead of tape.

While the invention has been described with reference to particular example embodiments, it is intended to cover all modifications and equivalents within the scope of the following claims.

I claim:

1. A multi-use recreational balance beam device comprising:

first and second balance beams, each balance beam comprising a pair of parallel spaced apart rails, each rail comprising a straight side edge and a curved side edge, and a pair of platform seats ridigly joining and spacing the pair of rails at each end, said platform seats joined to the straight side edges of the pair of rails so that the straight side edges lie in a common plane and the curved side edges lie in a common surface of curvature for rocking action;

said first balance beam having a pair of notches formed in the straight side edge of each rail centered along the rail and spaced apart from each other a distance equal to the spacing of the rails from each other;

said second balance beam having a pair of notches formed in the curved side edge of each rail centered along the rail and spaced apart from each other a distance equal to the spacing of the rails from each other, whereby the first and second balance beams may be arranged in interfitting cooperative relationship at right angles to each other defining a rectangle at the center of the interfitting balance beams, said notches formed so that the flat side edges of the rails of said respective beams lie in a common plane;

said interfitting balance beams being operatively arrangeable with the platform seats flush with the surface of the ground thereby forming a stable base for one rail or two rail walking along the curved side edges of the interfitting balance beams in either of two directions, or with the curved side edges facing down and bearing against the ground to provide a two way see-saw or rocker.

2. The device of claim 1 further comprising a locking piece, said locking piece comprising a locking plate having depending inserts therefrom for engaging and bearing against the inner surfaces of the center rectangle, said locking piece constructed and arranged for insertion into the center rectangle with the locking plate bearing against the side edges of the respective rails of the interfitting balance beams defining the center rectangle.

3. The device of claim 2 further comprising turning disc means, said turning disc means comprising coupling means for engaging the locking plate of the locking piece whereby said turning disc means affords a reduced bearing surface of the interfitting balance beams relative to the ground when the locking piece is inserted in the center rectangle from below whereby players sitting on the platform seats may turn the interfitting balance beams on the reduced bearing surface of the turning disc means in the manner of a merry-go-round.

4. The device of claim 1 further comprising a pair of guide plate means and a pair of guide bar means rigidly joining and spacing said guide plate means in parallel relationship, said guide bar means constructed and arranged for operatively engaging and seating within the notches formed in the curved side edges of the second balance beam for maintaining the guide plates substantially adjacent to the outer surfaces of the guide rails, said guide plates further serving operatively to retain the first balance beam on top of the second balance beam with respective curved side edges bearing against each other to form a see-saw with enhanced vertical rocking action.

5. The device of claim 4 wherein the curved side edges of the pairs of rails of the respective balance beams are formed with strips of non-slip material for non-slip engagement of the curved side edges relative to each other or relative to the ground and for non-slip one rail or two rail walking on the curved side edges of said rails.

6. The device of claim 4 wherein at least one of said guide plates is formed with visual target means, whereby said guide plates and guide bars may function as a free standing visual target spaced at a distance from said balance beams for visual coordination during one or two rail walking on the curved side edges of said balance beams.

7. The device of claim 1 wherein non-slip material strips are positioned on the platform seats and locking plate to provide non-slip characteristics for players using the device and for visual targets and visual coordination.

8. The device of claim 3 wherein said locking plate is formed with a central hole and wherein said turning disc coupling means comprises a stem for operatively engaging said central hole and seating the turning disc against the locking plate thereby forming the reduced bearing surface for turning of the interfitting balance beams on the reduced bearing surface by users sitting on the platform seats.

9. The device of claim 1 wherein said flat platform seats are each formed with a handle grip means at the inside thereof between the pair of rails of the respective balance beam whereby a player sitting on the platform seat may hold on and maintain balance with the hands away from the vicinity of the ground contact side of the rails of the balance beam.

10. A multi-purpose recreational balance beam device comprising:

first balance beam comprising a pair of parallel spaced apart rails, each rail having a straight side and a curved side, the straight sides of said rails lying in a common plane, said curved sides lying in a common surface of curvature for rocking action, a pair of flat platform seat members rigidly joining the pair of rails on the straight sides thereof in said parallel spaced apart configuration, each rail of the first balance beam having a pair of notches formed in the straight side thereof distributed on either side of the center of the rail and spaced apart a distance equal to the spacing of the rails from each other, second balance beam comprising a second pair of parallel spaced apart rails, spaced apart the same distance as the first balance beam, each rail having a straight side and a curved side, said straight sides lying in a common plane, said curved sides lying in a common surface of curvature for rocking action, each rail of the second pair of rails formed with a pair of notches formed in the curved side, said notches distributed on either side of the center of the rail and spaced apart a distance equal to the spacing of the rails from each other, and a pair of flat platform seat members rigidly joining the pair of rails on the straight sides thereof in said parallel spaced apart relationship;

said notches formed so that the first and second balance beams may be assembled in interfitting relationship at right angles to each other defining a rectangle at the center of the interfitting balance beams, the straight sides of the rails of the respective balance beams lying in a common plane, said curve sides also being coincident at the intersections of the rails of the interfitting balance beams whereby the interfitting balance beams may be placed with the straight sides down resting on the respective flat platform seats providing stable rails in two orthogonal directions for one rail or two rail walking, or placed with the curved sides down thereby affording a two way rocker or see-saw device;

locking piece means comprising a flat locking plate having projections means depending therefrom arranged to bear against the inner surfaces of the center rectangle formed by the interfitting balance beams, said locking piece constructed and arranged to be operatively inserted in said center rectangle with the flat locking plate bearing against the sides of the rails;

turning disc means and means for coupling said turning disc means to the flat locking plate of the locking piece when the locking piece is inserted into the center rectangle from below with the flat locking plate bearing against the coincident curved sides of the respective pairs of rails of the interfitting balance beams and with the curved sides of the balance beams facing downward, said turning disc affording a reduced bearing surface between the interfitting balance beams and the ground whereby said interfitting balance beams may be turned by users sitting on the platform seats and thereby function as a merry-go-round;

and a pair of guide plates, said guide plates spaced apart in parallel relationship and joined by a pair of guide bars, said guide bars constructed and arranged for operatively seating in the notches of the second balance beam having notches formed in the curved sides thereof so that the second balance beam may form a stable base with the platform seats facing the ground and the curved sides of the rails facing upward, said guide plates held adjacent to the outsides of the rails with the guide bars seated in the notches, and whereby said first balance beam may be positioned with the curve sides of the rails facing downward and abutting against the upward facing curved sides of the rails of the second balance beam thereby providing a see-saw for rocking the first balance beam on the second for enhanced vertical rocking action, the rails of said respective balance beams held in alignment on each other by said guide plates.

11. The device of claim 10 wherein a non-slip material strip is formed on the curved sides of the pairs of rails of the respective first and second balance beams thereby providing non-slip contact between said curved sides and the ground or said curved sides with respect to each other, and for providing non-slip walking along the curve sides of said respective rails when the balance beams are used for one rail and two rail walking.

12. The device of claim 10 wherein a visually distinguishable target is formed on the side of at least one of said guide plates whereby said guide plates may function as a free standing visual target spaced at a distance from the balance beams for visual coordination when the balance beams are used for one or two rail walking.

13. The device of claim 10 wherein non-slip material strips are positioned on the platform seats and locking plate to provide non-slip charactersitics for players using the device and for visual targets and visual coordination.

14. The device of claim 10 wherein said locking plate is formed with a central hole and wherein said turning disc coupling means comprises a stem for operatively engaging said central hole and seating the turning disc against the locking plate thereby forming the reduced bearing surface for turning of the interfitting balance beams on the reduced bearing surface by users sitting on the platform seats.

15. The device of claim 10 wherein said flat platform seats are each formed with a handle grip means at the inside thereof between the pair of rails of the respective balance beam whereby a player sitting on the platform seat may hold on and maintain balance with the hands away from the vicinity of the ground contact side of the rails of the balance beam.

* * * * *